United States Patent [19]

MacHarrie

[11] Patent Number: 4,720,610

[45] Date of Patent: Jan. 19, 1988

[54] MEMBRANE KEY SWITCH WITH ANTI-INVERSION FEATURE

[75] Inventor: Robert A. MacHarrie, Hillsborough, N.H.

[73] Assignee: AMP Incorporated, Harrisburg, Pa.

[21] Appl. No.: 943,973

[22] Filed: Dec. 19, 1986

[51] Int. Cl.[4] ..... H01H 13/70

[52] U.S. Cl. ..... 200/5 A; 200/159 B

[58] Field of Search ..... 200/5 R, 5 A, 159 B, 200/86 R

[56] References Cited

U.S. PATENT DOCUMENTS

| | | | |
|---|---|---|---|
| 3,684,842 | 8/1972 | Boulanger | 200/85 R |
| 3,860,771 | 1/1975 | Lynn et al. | 200/5 A |
| 3,978,297 | 8/1976 | Lynn et al. | 200/5 A |
| 3,995,126 | 11/1976 | Larson | 200/159 B |
| 4,066,851 | 1/1978 | White et al. | 200/5 A |
| 4,286,129 | 8/1981 | Petit | 200/159 B |
| 4,314,116 | 2/1982 | Gordon | 200/5 A |
| 4,423,294 | 12/1983 | Walser et al. | 200/5 A |

OTHER PUBLICATIONS

AMP Keyboards—Your Competitive Edge.

*Primary Examiner*—J. R. Scott

*Attorney, Agent, or Firm*—Katherine A. Nelson

[57] ABSTRACT

A keyboard matrix switch (10) is provided which features a membrane layer (22) having dimples (30) therein at each key switch site to provide a proper tactile feel upon actuation. Each dimple (30) is provided with a series of ribs (34, 36, 38, FIG. 3) formed in the membrane layer (22) and radiating outwardly from the dimple to preclude overtravel and locking of the dimple in an inverted position (as in FIG. 1).

15 Claims, 5 Drawing Figures

MEMBRANE KEY SWITCH WITH ANTI-INVERSION FEATURE

This invention relates to a matrix switch of the membrane type wherein there is provided a dimple formed in the membrane at each key switch point adapted to provide a proper tactile feel upon actuation of the key switch formed thereby.

BACKGROUND OF THE INVENTION

Membrane switch technology is widely used because its production costs are relatively low as compared with the traditional full travel keyboard which contains key plunger mechanisms. Membrane switches are used additionally because of the considerable design flexibility in terms of panel layout, including the key size and shape and graphic labels. Perhaps more importantly membrane switch construction readily affords an improved enclosure, which protects the contacts thereof from hostile environments and against dust accumulation, spills and the infestation of fungi and vermin. Membrane switches afford a ready cleaning of the upper surface and a very low profile as compared with traditional key switches.

Despite these advantages, there has been some resistance to the use of membrane switches due to a perceived need for the user in feeling the movement of the switch as a tactile feedback, indicating switch closure. To answer this need, a wide variety of bubbles or dimples have been developed to be formed into the membrane or an associated layer which physically move and offer a varying force displacement characteristic favored by users. Examples of dimple membrane switches are given in U.S. Pat. Nos. 3,860,771; 3,978,297 and 4,066,851.

With the use of such dimples have come problems relating to the dimples being inverted by the pressure of closure to lock up and render the switch inoperable. This problem has manifested itself in those membrane switch constructions which are "dry", not having adhesive materials binding the various layers or laminate together. Additionally, the problem known as dimple inversion is most troublesome in switch constructions wherein there is a layer covering the dimple for sealing or other reasons. These constructions include switches having rubber or elastomer key shapes or rigid key shapes made to overlay the membrane switch site and provided with actuator projections which bear upon the dimples to effect switch operation.

SUMMARY OF THE INVENTION

The present invention relates to a matrix key switch of the membrane type wherein there are laminations of dielectric film material and plastic sheet material having selectively disposed thereon, conductive paths which form the contact points of the switch. Included in one of the membrane layers are a stiffening means via a series of dimples arranged at each key switch site to provide an appropriate tactile feel to the key switch user. In accordance with the invention, there is provided in the membrane that forms the dimple of the invention switch construction a series of ribs which radiate outwardly and are disposed around the periphery of each dimple to stiffen the membrane film material and preclude the buckling condition which has been discovered to lock the dimple in a downward or closed position to result in inoperability of the switch site. Accordingly, it is an objective of the invention to provide an improved membrane switch of the type having dimples intended to provide an appropriate tactile feel to switch operation. It is particularly an object of the invention to provide a dimpled membrane switch construction which precludes dimple inversion in use of the switch.

DETAILED DESCRIPTION OF THE INVENTION

Figures 1, 2:
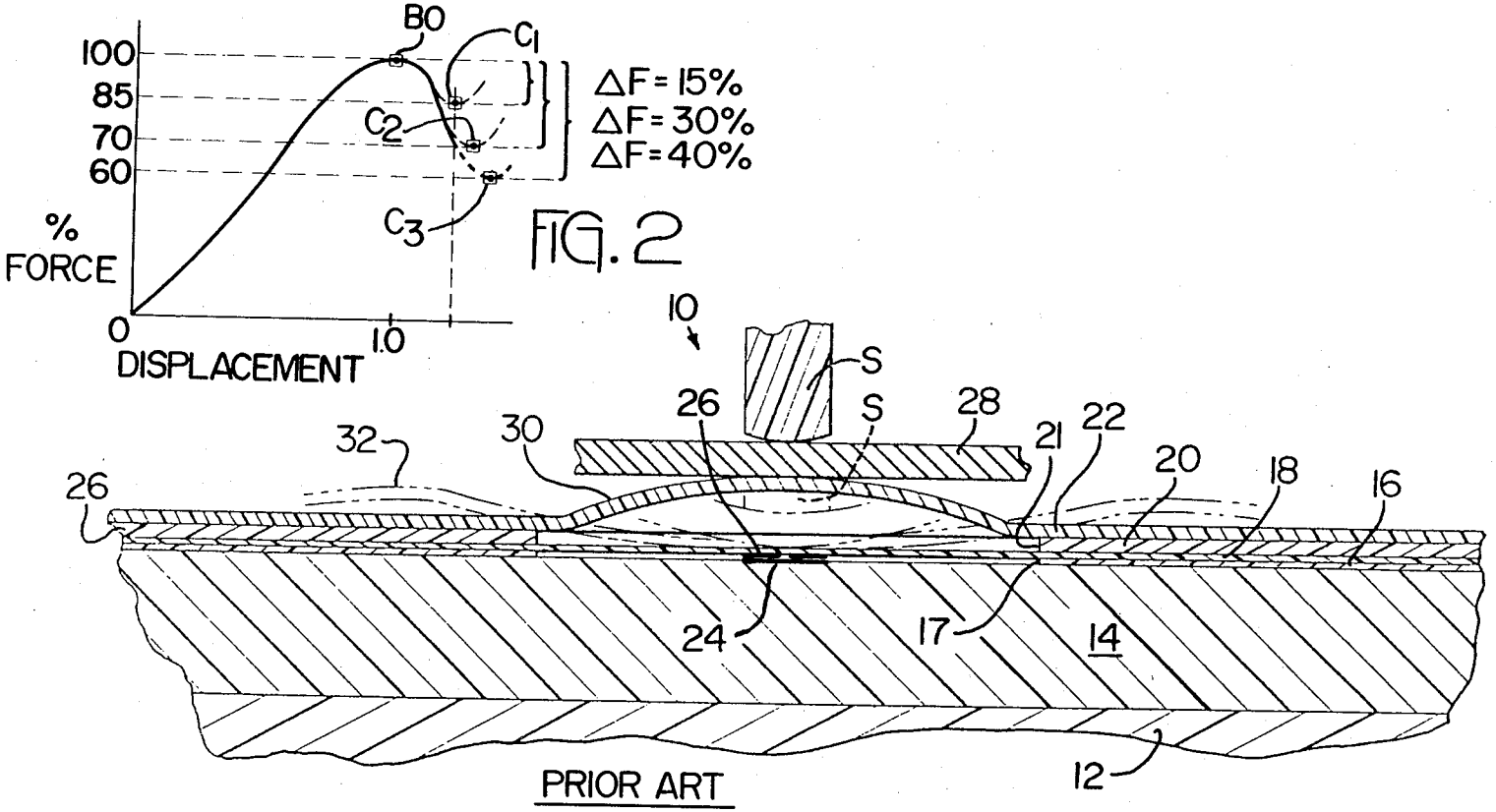
FIG. 2 PRIOR ART
FIG. 1 is a side and sectional view of a membrane key switch site showing the construction of a dimpled membrane switch in accordance with the prior art and revealing the inversion phenomena solved by the present invention assembly.
FIG. 2 is a schematic representation of a membrane key switch force/travel curve intended to help in understanding the invention.

Referring now to FIG. 1, there is shown a key switch site which may be taken to be one of many in a keyboard. It is comprised of a series of layers of flexible and inflexible plastic material and an array of conductive circuit traces, which when driven together contact to effect a switch closure. The key switch site 10 is typically one of many in a keyboard switch. It is comprised as heretofore discussed of a series of layers. The base plate shown as 12 is typically of a rigid plastic material but may optionally be a sheet metal material or indeed in certain instances, depending upon the characteristics of the additional layers, may be omitted. In the present description, base plate 12 may be taken to be a rigid thermoset material. Directly adjacent to base plate 12 is a layer 14 which in the present description, is a printed circuit board having conductive traces thereon which define contact points 24 and half of the switch structure in a manner described in the previously mentioned patents given in the Background of the invention. While shown as a printed circuit board, layer 14 could also be a flexible layer having conductive traces disposed thereon by screening or etching techniques as known in the art. If layer 14 is flexible, it would need to be supported by rigid base plate 12. Overlying layer 14 is a layer 16 which operates as a first spacer layer and includes an aperture 17 which creates a space between contact points 24 and a contact surface carried on a flexible layer 18. Layer 18 has conductive traces 26 thereon, layer 18 being the membrane layer the switch. Immediately adjacent and overlying layer 18 is a second spacer layer 20 including an aperture therein 21. Overlying layer 20 is flexible layer 22 which includes the bubble or dimple 30 in FIG. 1. Immediately overlying layer 22 is an elastomeric sheet forming an upper layer 28 and on top of layer 28, a stylus element shown as S.

As can be visualized from FIG. 1, the downward movement of S to the position shown in phantom will depress the various layers 28, 22, and 18 to effect a switch closure between the contact points 24 and 26. In accordance with a necessary aspect of any key switch site, retraction of S should allow dimple 30 to restore itself to the upward position, in turn allowing the layer 18 to move upwardly, opening the switch between contact points 24 and 26. This is achieved in general by the nature and characteristics of the layer 18 which is typically a polyester film which tends to restore itself to a planar position once the force of displacement caused by S acting through layer 22 is removed. In many prior art membrane switches the various layers represented as in FIG. 1, including particularly the layers 14, 16, and 18, were bonded or laminated together as by adhesives, silkscreened or otherwise applied to the surfaces of these layers except for the apertures therein to result in a bonding which precludes displacement of the various layers.

This bonding was particularly important with respect to the dimpled layer 22 in that the bonding resisted movement of layer 22 outwardly in a radial sense from the center of the dimpled 30 or vertically relative to the surfaces of layer 20.

In accordance with the preferred construction of the invention version of a membrane switch, the various layers as shown in FIG. 1 do not contain adhesives to bind such layers together, rather the layers are held by a series of plastic columns which penetrate the layers periodically and are heat formed or heat staked to hold the layers together in use. This practice not only avoids the additional labor entailed in precision applications of adhesive, but further avoids the subsequent problems of delamination upon adhesive failure or shrinkage or for other reasons. The problem caused by the use of so-called "dry" stacking of layers in membrane switches is revealed in FIG. 1 relative to the area shown by numerals 32. There it can be seen that the flexible material of layer 22 has moved upwardly causing a buckle which extends around the periphery of dimple 30. This buckling of the film material has been discovered to cause, on occasion, an inversion of the dimple, 30 into a locked position downwardly, holding the contact points 24 and 26 closed and resulting in a failure of the switch. This problem which is known as dimple inversion has proved to be a subtle one and has caused considerable problems in the manufacture of lamina membrane switches of the "dry" construction. The problem is exacerbated by the extreme thinness of the elements and the fact that the phenomena, that is dimple inversion, has not consistently manifested itself in each switch of a matrix key switch, but only occasionally in an almost random way, making for difficulty in analysis and study. Moreover, because of the layered nature of the switch construction, the problem is literally covered over by the additional layers which when separated for examination, result in the dimple inversion disappearing prior to examination.

Prior to turning to a description of the invention solution to the foregoing problem, reference is now made to FIG. 2 to provide background and comprehension of the nature of the problem and its solution. FIG. 2 reveals a force/travel curve which relates to the force that it takes to effect a switch closure, such force being shown as F relative to displacement shown as D, which displacement relates to the movement of the stylus S. With respect to FIG. 2, the force applied may be in grams, ounces or pounds, etc. The units shown, 60, 85 and 100 represent only percentages of force. The units shown for D also represent only normalization or percentage of total travel but typically would be expressed in thousandths of an inch the unit of 1 representing the position of S when the force equals 100% and the point at which the dimple inverts. The curve that is shown in FIG. 2 thus represents the force travel characteristics for three different keys of membrane switches, each having different dimple characteristics. This curve in fact represents the accumulation of the different forces in their respective displacements as S is moved from the initial position shown solidly in FIG. 1 to the phantom position there shown. Understanding that there is some compression due to the elastic nature of the different layers, particularly layer 28 and in certain applications wherein S is made of an elastomer in the column of S itself, the force/travel curve must be understood not to solely be representative of the characteristics of the dimple 30, but really an integration of all of the various force and displacement characteristics of the different layers. It will be understood that should the layers be made more rigid, the gradient of the force/travel curve of FIG. 2 would be sharper and would extend to a greater extent than is shown. By the same token, if the forces are reduced by changing the characteristics of the bubble or dimple or the other layers, the gradient would be proportionately reduced. Their characteristics can also be altered by arranging for different thicknesses of the spacers such as layers 16 and 20.

Suffice to say, the critical aspect of a key switch in terms of a force/travel characteristic is related to the point shown as BO in FIG. 2, representing the breakover point or the point at which the dimple 30 inverts and moves downwardly suddenly reducing the force requirement to effect displacement. This provides the tactile sensation so necessary in the switch action. The next point of consideration shown in FIG. 2 is point labeled $C_1$ which represents the contact point wherein switch closure is made. The difference between the point BO and the point $C_1$ is in switch pariance known as the delta or delta force ($\Delta F$) which is really the force differential between breakover and contact, which is represented as 15% in FIG. 2. As can be appreciated, if the force level wherein $C_1$ occurs is only slightly less than that where BO occurs relative to displacement, the switch will have very little tactile feel. As a consensus from users, a $\Delta F$ on the order of 30 or even 40 percent as evidenced by the curve portion shown in FIG. 2 related to contact point $C_2$ and $C_3$, respectively, provides a much improved tactile feel. As can be appreciated, very slight changes in the material or geometrical characteristics of dimple 30 or the other moving layers of the membrane switch structure can alter the delta force to the advantage or disadvantage of user satisfaction through altered tactile feel.

Figure 3:
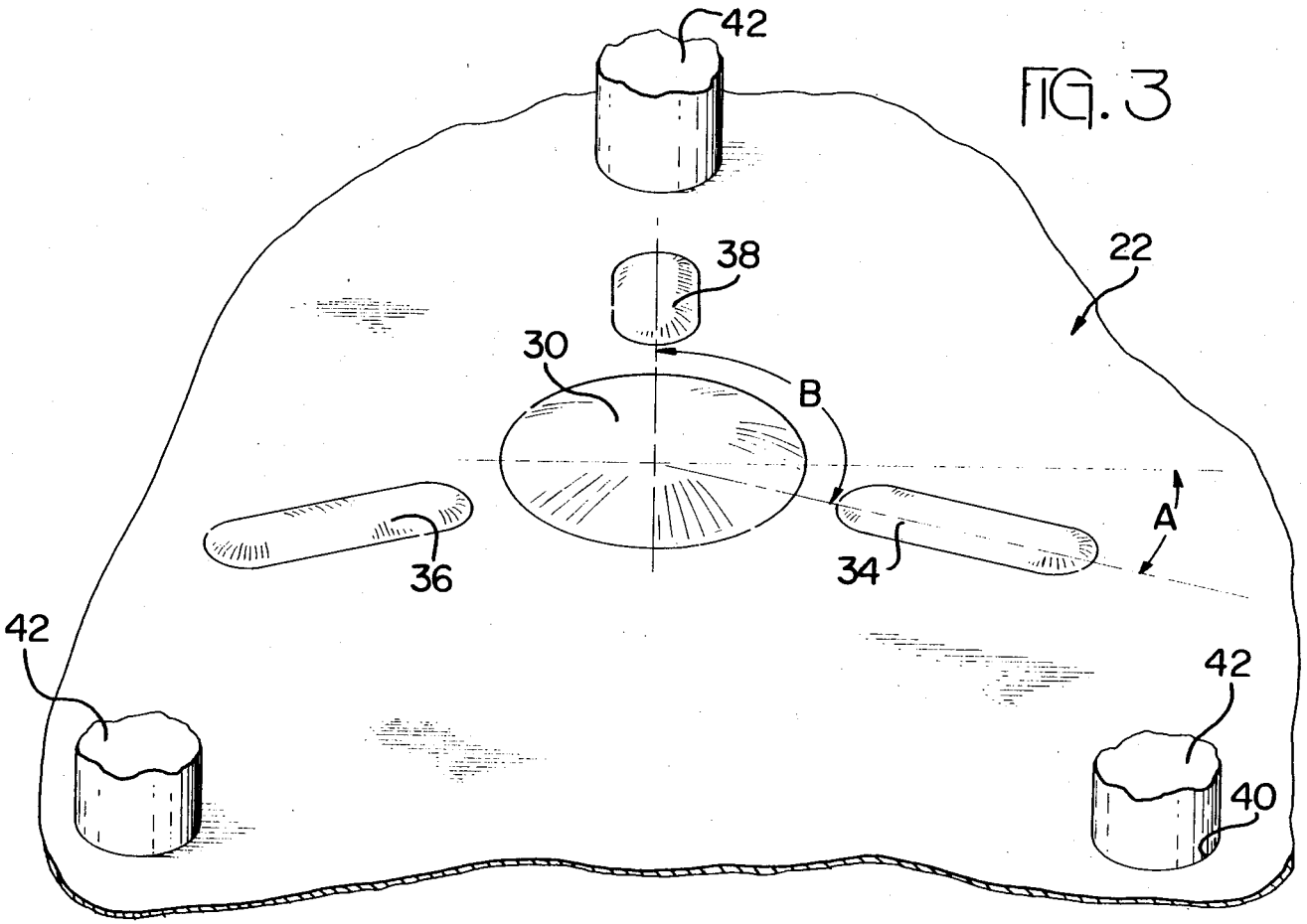
FIG. 3 is a perspective view of the invention showing the membrane dimple and the membrane ribs intended to preclude dimple inversion.

Reference is now made to FIG. 3 which shows in a perspective view a much enlarged representation of the dimpled layer 22, including the dimple 30 itself. To give a better perspective, it is to be realized that the dimple 30 shown in FIG. 3 has a diameter less than a quarter of an inch. Also to add perspective at this point in the description, it is to be realized that layer 22 is on the order of five or less than five thousandths of an inch in thickness.

Before continuing with the detailed construction as to the dimple and related structure, reference is made to FIG. 3 and to the elements 42 which are in fact plastic columns which project through the layers of the switch 10 through apertures such as 40 shown in the membrane layer 22. These columns or posts are typically drawn from the material of the base plate 12 or alternatively, down from a facade structure which lies in a plane, not shown, above the top face of the switch structure. In accordance with usual practice in the so-called "dry" type of laminations, these columns are inserted through the various layers and heat staked on one side while the layers are clamped together. The use of columns thus serves to hold the layers generally in both a horizontal and vertical sense and to maintain their position throughout the life of the switch. Columns 42 would be distrubuted throughout the face of a switch in essence between each contact switch site and around the periphery thereof to effect such holding of the layers.

Figure 4:
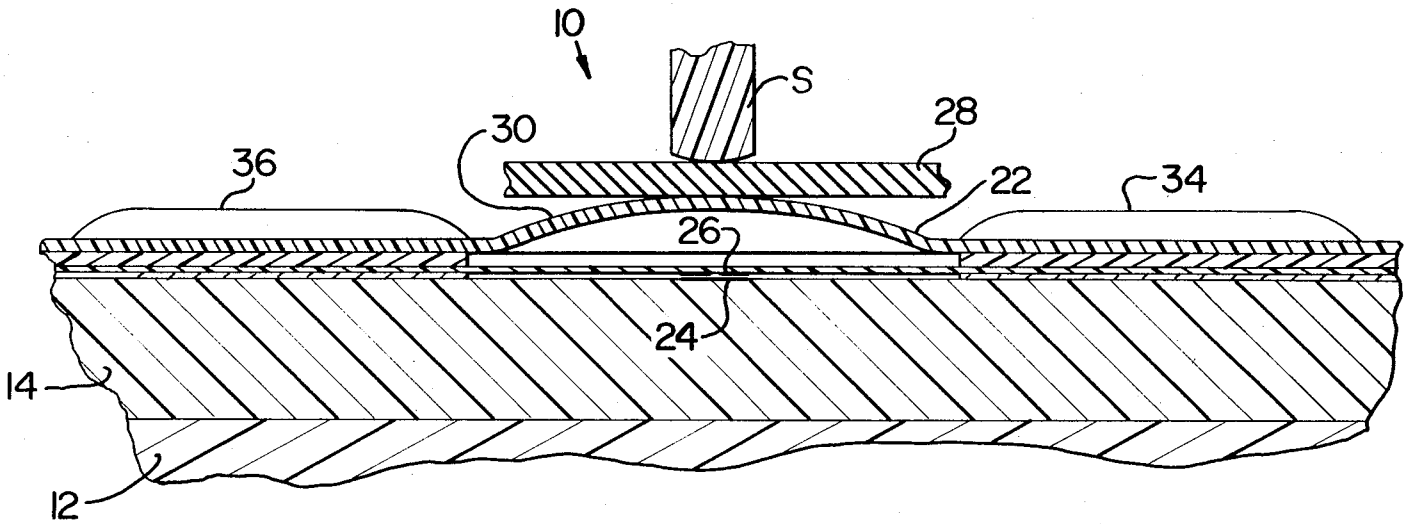
FIG. 4 is an elevational view of the invention showing in section the details of the membrane switch site construction prior to actuation in closure.
Figure 5:
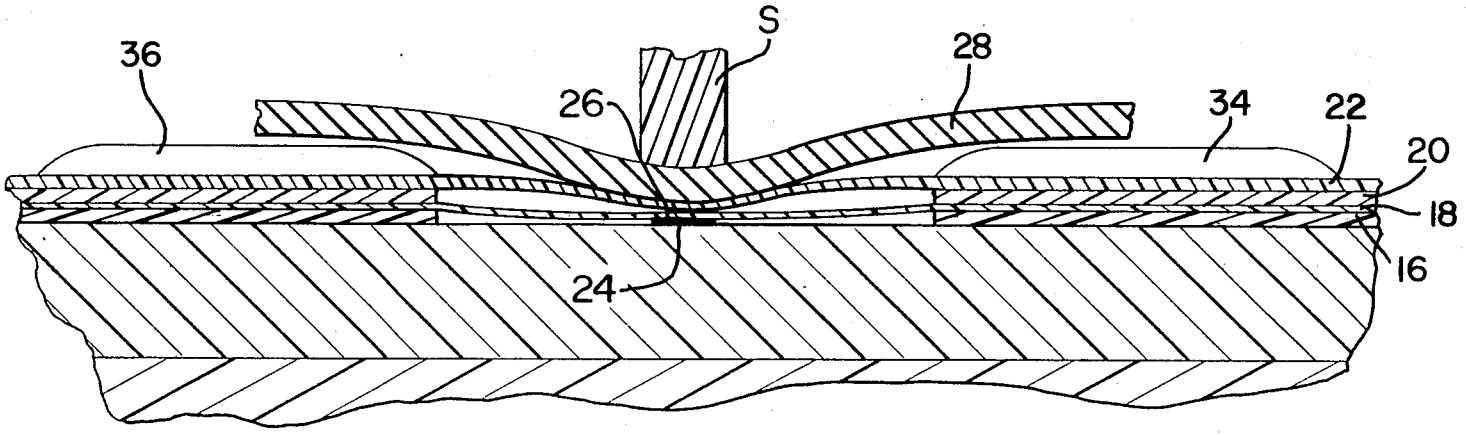
FIG. 5 is a view of the construction of FIG. 4 actuated to effect switch closure.

Turning now to FIGS. 3–5, attention is drawn to the ribs shown as 34, 36, and 38 which extend radially outwardly from the dimple 30 and around the periphery thereof. Ribs 34, 36 and 38, are formed of the material of the membrane layer 22, and preferably formed at the same time that the dimple 30 is formed. In accordance with a preferred embodiment of the invention, the membrane layer 22 is formed of a polyethylene terephthalate film. Generally, films such as used for layer 22 are known as polyester films and may range from 2 to 10 thousandths of an inch in thickness, more typically being on the order of between of 3 and 5 thousandths of an inch. The dimple 30 and the ribs 34, 36, and 38 are formed between dies in the presence of heat and pressure and time. In an actual embodiment of the invention, the polyester film was of a thickness on the order of 0.005 inches, a type E or graphics quality polyester film, with the dimple and rib shapes being formed into a female die. The film was clamped between the die and a layer of silicone rubber and maintained under pressure and heat, for a suitable period of time. The parameters of temperature, pressure and time are varied according to the properties of the material being formed. The operating conditions are generally in the ranges of 250°–350° F. at 15–50 tons for a suitable period of time, typically 10–20 seconds. The bubble and ribs take a permanent set to the general configuration shown in FIGS. 3–5, even though the temperature employed is considerably below the melting point of polyester films.

Referring now to FIG. 4, the key switch site 10 can be seen just prior to actuation of the stylus S. As can be discerned from FIG. 4, the contact points 24 and 26 are in an opened position with the membrane layer 18 being in a horizontal and undeformed position. FIG. 5 shows the switch closed with the contact point 24 and 26 pressed together through the downward displacement of membrane layer 18 by the interior center surface of dimple 30, in turn under compression of the elastomeric layer 28 which itself is being deformed by the downward movement of the stylus S.

The disposition of two of the ribs, 34 and 36, can be seen in relative scale in both FIGS. 4 and 5 to operate as stiffening beams precluding the film of layer 22 from lifting or bubbling up around the periphery of dimple 30.

It will be observed from FIG. 3 that the rib 38 is somewhat shorter than the ribs 34 and 36, the relative length of 38 having been adjusted for purely physical and dimensional reasons. The presence of the ribs around the periphery was found to sufficiently stiffen the entire periphery to avoid lifting of layer 22 and any tendency of the dimple 30 to become permanently inverted or to lock together in the closed condition heretofore of concern.

In an actual embodiment of the invention, the dimple 30 had a radius on the order of 0.0935 inches and had a depth from the bottom of the plane of the layer 22 on the order of 0.029 inches. The dimple 30 was formed to have a spherical radius of 0.375 inches. The ribs were spaced from the edge of the dimple on the order of 0.030 inches. Ribs 34 and 36 were aligned along an axis from the horizontal shown as angle A equal to approximately 20 degrees and the rib 38 was placed along an axis at an angle B of roughly 90 degrees. The ribs were made to have a length of approximately 0.200 inches for ribs 34 and 36 and a length of 0.100 inches for rib 38. These ribs each had a width of roughly 0.046 inches. In an actual embodiment, the base plate 12 was on the order of 0.060 inches, the printed circuit board layer 14 was on the order of 0.062 inches and contained traces of one ounce copper suitably plated. The other layers including the polyester layers 16 and 18 were on the order of 0.003 inches in thickness, with the spacer layer 20 being on the order of 0.007 inches in thickness and the layer 22 having a thicknes of 0.005 inches. Layer 18 had conductive traces thereon on the order of 0.0005 inch thickness. The rubber layer 28 had a thickness of approximately 0.015 inches. The diameter of the aperture 21 in layer 20 was on the order of 0.218 inches. The center of the nearest post 42 from the center line of dimple 30 was on the order of 0.225 inches. The posts 42 were comprises of A.B.S. material formed from the base plate and were on the order of 0.025 inches in diameter.

A membrane switch having 16 contact sites and comprised of the construction heretofore given was cycled in excess of a half million times and worked quite successfully without lockups or permanent inversions of the bubble or dimple. This example had a delta force on the order of 30 percent.

While the foregoing dimensions and example of a functioning switch have been included to enable the practice of the invention, such details are included for the purposes of illustration and not limitation. It is to be understood that the invention embraces a stiffening of the film from which the bubble or dimple is manufactured, causing such film to remain in a planar state during actuation of the dimple in the region surrounding the dimple to thus cause the dimple to return to the upward position and thus avoid a lockup condition with the dimple permanently inverted and causing contact closure.

While the invention has been disclosed in an illustrative embodiment of having been made to include films of the polyethylene terepethylate material, it is contemplated that other films may be utilized as long as they have the flexible characteristics called for. Such films could include among others, those which are termed polyimides, polyimide-amides, polycarbonates, polysulfones, polyamides, and those of the cellulose triacetate.

It will also be understood that dimples having a different spherical radius and dimples having different diameters as well as thicknesses may be employed. So to with respect to the contact carrying layers 14 and 18 and the elastomeric buffer layer 28. The important point relative to variations is that the combination of rigid and elastic structures including both dimensions and geometry result in a displacement which provides a good tactile feedback. In general, five thousandths of an inch displacement is not sufficient to provide a good tactile feel although such displacement can provide an adequate membrane switch for certain purposes. It is felt that dimple displacements on the order of 20 thousandths or 30 thousandths or more are better in regards to providing tactile feel. In all of this, it is well worth keeping in mind that an important aspect is to provide a delta force in excess of 20 percent, preferably 30 or 40 percent or more.

In respect to the use of rib structures, it is to be understood that these provide a stiffening as heretofore described and that more than three ribs might be chosen to do the job or perhaps ribs of a different geometry and configuration, as long as the ribs do provide the stiffening to serve as a means sufficient to avoid lifting of the film material at the periphery of the dimple which results in a lockup in the inverted position.

I claim:

1. A membrane switch of the matrix type including a plurality of contact sites and a plurality of layers with means for clamping said layers mechanically together, comprising:

a first layer having at least one first conductive trace thereon defining at least one first contact point for each contact site of said matrix switch;

a flexible second layer having at least one second conductive trace thereon defining at least one second contact point for each said contact site of said matrix switch;

a spacer means between said first and second layers to hold said first and second contact points normally apart;

a third layer comprised of a flexible membrane material, said layer including a curvilinear dimple disposed over said first and second contact points of said first and second layers, said dimple having an upward and inverted position relative to said third layer, such that by pressure to said dimple to move said dimple from its upward to its downward position, said dimple effects closure of said contact site by pressing said second layer against said first layer to electrically engage said at least one second contact point on said second layer with said at least one contact point on said first layer; and means for stiffening said material of said third layer in the plane of said material parallel to said first and second layers and around the periphery of each said dimple, said stiffening means extending radially outwardly from the center of each said dimple, thus precluding lifting of said third layer of material and locking of said dimple in the downward position upon effecting closure at a contact site.

2. The switch of claim 1 wherein said stiffening means is comprised of a series of ribs formed in the membrane material of said third layer around the periphery of each said dimple.

3. The switch of claim 2 wherein there are three such ribs and each of said ribs has a length relatively greater than the width thereof.

4. The switch of claim 1 wherein said first layer is a relatively flexible layer.

5. The switch of claim 4 further comprising a rigid support surface which underlies said first layer.

6. The switch of claim 1 wherein the said diple has a height approximately one-third of the radius thereof and the thickness of the third layer is on the order of one-twentieth of the radius of the said dimple.

7. The switch of claim 1 wherein said first layer is a relatively rigid layer.

8. The switch of claim 1 further comprising a rigid support surface which underlies said first layer.

9. A membrane switch having a series of layers of dielectric material comprising:

a first layer containing at least one first contact point on the surface thereof;

a second layer of flexible film material containing at least one second contact point positioned above said first contact point;

a third layer including a dimple therein positioned over said contact points, said dimple including an upward position spaced from said second layer and a downward position bearing against said second layer to displace said at least one contact point thereon against said contact point of said first layer to effect switch closure;

means for holding said layers together via mechanical clamping; and means for stiffening said third layer peripherally about said dimple to avoid said dimple from locking in an inverted downward position causing switch failure, said stiffening means extending radially outwardly from one center of said dimple.

10. The switch of claim 9 wherein said stiffening means is comprised of a series of ribs permanently formed in said third layer.

11. The switch of claim 10 wherein said second and third layers are of an insulating film less than 0.010 inches in thickness.

12. The switch of claim 9 wherein said first layer is a relatively flexible layer.

13. The switch of claim 12 further comprising a rigid support surface which underlies said first layer.

14. The switch of claim 9 wherein said first layer is a relatively rigid layer.

15. The switch of claim 9 further comprising a rigid support surface which underlies said first layer.

* * * * *